US005711170A

United States Patent [19]

Johnson

[11] Patent Number: 5,711,170

[45] **Date of Patent: *Jan. 27, 1998**

[54] INTEGRATED TUB AND CABINET STRUCTURE

[75] Inventor: Troy Johnson, Newton, Iowa

[73] Assignee: Maytag Corporation, Newton, Iowa

[ * ] Notice: The term of this patent shall not extend beyond the expiration date of Pat. No. 5,526,657.

[21] Appl. No.: 614,397

[22] Filed: Mar. 12, 1996

Related U.S. Application Data

[63] Continuation-in-part of Ser. No. 293,399, Aug. 19, 1994, Pat. No. 5,526,657.

[51] Int. Cl.[6] ..... D06F 37/26

[52] U.S. Cl. ..... 68/3 R; 68/133; 134/201; 312/228

[58] Field of Search ..... 68/3 R, 133, 235 D, 68/131, 132; 134/57 D, 56 D, 58 D, 200, 201; 312/228, 228.1; 366/314

[56] References Cited

U.S. PATENT DOCUMENTS

| | | | |
|---|---|---|---|
| 1,669,073 | 5/1928 | Albach . | |
| 2,161,604 | 6/1939 | Watts | 68/23 |
| 2,230,059 | 6/1941 | Hurley, Jr. | 68/3 R |
| 2,389,774 | 11/1945 | Haberstump | 220/10 |
| 2,641,426 | 6/1953 | Rauschner | 248/22 |
| 2,676,477 | 4/1954 | Smith | 68/196 |
| 2,684,585 | 7/1954 | Smith | 68/133 |
| 3,206,267 | 9/1965 | Gruner | 312/228 |
| 3,318,117 | 5/1967 | Padial | 68/23.3 |
| 3,321,843 | 5/1967 | Taran | 34/133 |
| 3,376,718 | 4/1968 | Kahn | 68/4 |
| 3,406,543 | 10/1968 | Trouilhet | 68/132 |
| 3,557,579 | 1/1971 | Marshall | 68/23.3 |
| 3,800,622 | 4/1974 | Stelwagen | 74/573 F |
| 4,202,187 | 5/1980 | Hukuzawa et al. | 68/23.3 |
| 4,528,827 | 7/1985 | Largen | 68/23.2 |
| 4,936,117 | 6/1990 | Kabeya | 68/3 R |
| 4,991,247 | 2/1991 | Castwall | 8/158 |
| 5,280,660 | 1/1994 | Pellerin | 8/158 |

FOREIGN PATENT DOCUMENTS

| | | | |
|---|---|---|---|
| 1 008 696 | 5/1957 | Germany | 68/133 |
| 61-37196 | 1/1986 | Japan | 68/3 R |
| 1730289 | 4/1992 | Russian Federation | 68/3 R |
| 1521797 | 11/1989 | U.S.S.R. | 68/3 R |

OTHER PUBLICATIONS 116,044 EP Aug., 1994 67/3 R.

*Primary Examiner*—Frankie L. Stinson

*Attorney, Agent, or Firm*—Zarley, McKee, Thomte, Voorhees, & Sease

[57] ABSTRACT

A laundry appliance cabinet includes a first panel member of integral construction and at least one additional panel member joined to the first panel member to form a plurality of exterior cabinet walls and a tub within those exterior walls.

20 Claims, 4 Drawing Sheets

INTEGRATED TUB AND CABINET STRUCTURE

CROSS-REFERENCE TO A RELATED APPLICATION

This application is a continuation-in-part of application Ser. No. 08/293,399 filed on Aug. 19, 1994 and now U.S. Pat. No. 5,526,657 for Inventor, Troy Johnson.

BACKGROUND OF THE INVENTION

The present invention relates to an integrated tub and cabinet structure for a laundry appliance.

Previous laundry washing appliances include a spinning basket rotatably mounted inside a tub. The tub is mounted within a cabinet in such a manner that the tub can move relative to the cabinet.

In order to achieve stability of the tub and rotating fabric spinning basket, a heavy ring of concrete is commonly placed around the upper rim of the spring basket. The forces created by the spinning basket within the tub require that the tub be made of a strong material such as metal, and also require that the tub and the surrounding cabinet not be of integral construction.

Recent technology has provided means for more easily dynamically balancing the rotating spinner basket while it is rotating so as to compensate for irregular distribution of weight such as might be encountered with a rug contained within the spinning basket. Examples of methods and means for achieving this dynamic balancing are illustrated in U.S. Pat. Nos. 3,800,622; 4,528,827; 4,991,247; and 5,280,660.

The ability to dynamically balance the spinning basket eliminates the need for strong support members for supporting an internal tub within a cabinet structure.

Therefore a primary object of the present invention is the provision of an improved integrated tub and cabinet structure.

A further object of the present invention is the provision of an integrated tub which forms a part of the cabinet and which is not a separate component.

A further object of the present invention is the provision of an integrated tub and cabinet structure which can be formed substantially of plastic.

A further object of the present invention is the provision of an improved integrated tub and cabinet structure which can be molded from plastic into several component parts which can be easily assembled in order to provide both the exterior cabinet walls and the interior tub for receiving a rotatable fabric basket therein.

Another object of the present invention is the provision of an integrated tub and cabinet structure molded from plastic into one-piece cabinet panel members wherein each panel member forms a part of the exterior cabinet walls.

A further object of the present invention is the provision of an integrated tub and cabinet structure which includes a tub chamber capable of holding washing fluid.

A further object of the present invention is the provision of an improved integrated tub and cabinet structure which is of lighter weight than prior cabinet and tub combinations.

A further object of the present invention is the provision of an improved integrated tub and cabinet structure which is economical to manufacture, durable in use, and efficient in operation.

SUMMARY OF THE INVENTION

The foregoing objects can be achieved by a laundry appliance cabinet which includes a first cabinet panel member of integral construction. At least one additional cabinet panel member is operatively joined to the first cabinet panel member to form a plurality of exterior cabinet walls and a chamber within those exterior cabinet walls. The chamber is fluid tight and capable of receiving a rotatable fabric basket therein. All or a substantial portion of the first and second cabinet panel members may be formed of plastic or light weight material.

DETAILED DESCRIPTION OF THE PREFERRED EMBODIMENT

Figures 1, 2, 3:
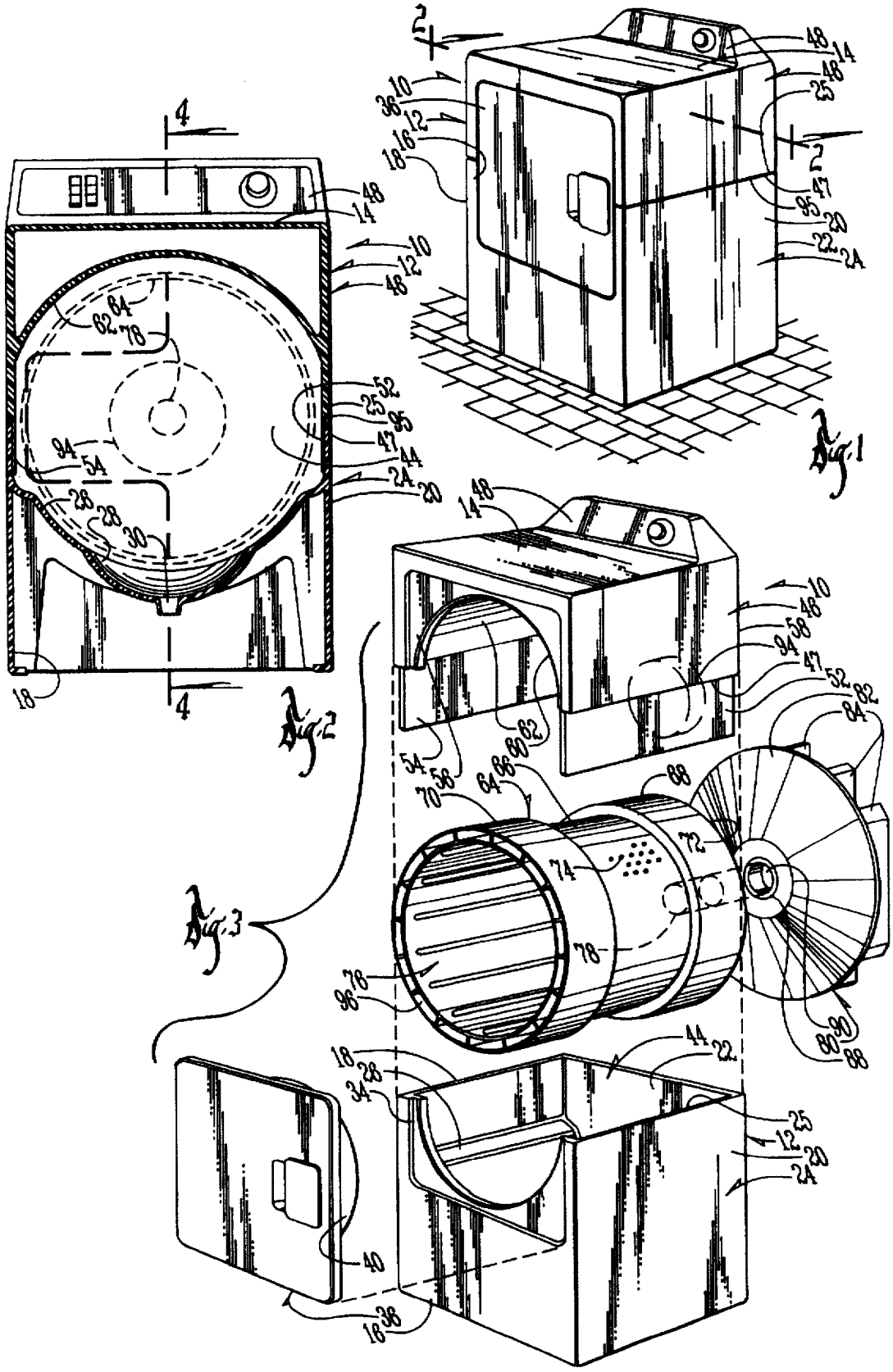
FIG. 1 is a pictorial view of a laundry appliance using the integrated cabinet and tub structure of the present invention.
FIG. 2 is a sectional view taken along line 2—2 of FIG. 1.
FIG. 3 is an exploded pictorial view of the components which make up the laundry appliance in FIG. 1.

Referring to FIGS. 1–4 a laundry appliance 10 is shown having a cabinet 12. Cabinet 12 is comprised of a top wall 14, a front wall 16, a pair of side walls 18, 20, and a rear wall 22. Cabinet 12 is comprised of a lower subassembly or panel member 24 and an upper subassembly or panel member 46. Lower subassembly 24 includes a tub bottom wall 26 having a drain indentation 28 with a drain hole 30 at the bottom thereof. Front wall 16 also is part of lower subassembly 24 and includes a door opening 34 therein having a door 36 which is movable into covering relation over door opening 34. A seal 38 is provided between the door 36 and the margins of the door opening 34. Door 36 also includes a cylindrical door flange 40 which protrudes into the interior of the cabinet 12 when the door 36 is closed. Lower subassembly 24 also includes side walls 18, 20 and rear wall 22. Rear wall 22 is provided with a motor opening 42. Within the exterior walls 16, 18, 20, 22, and tub bottom wall 26 is a tub chamber 44 for receiving a fabric basket 64 which is rotatable in chamber 44.

Upper subassembly 46 includes a control panel housing 48. Extending downwardly from top wall 14 are two vertical side panels 52, 54, a front panel 56, and a rear panel 58. Front panel 56 is provided with a circular arch 60, and rearwardly of circular arch 60 is an arched wall 62 (FIG. 2).

Upper subassembly 46 and lower subassembly 24 are preferably molded into separate single pieces made of plastic. However, the various components of the subassemblies 24, 46, may be made of separate plastic pieces which are joined together to form the two subassemblies. As can be seen in FIG. 3 the upper subassembly 46 is adapted to telescopically fit within the open upper ends of the exterior walls 16, 18, 20, 22, of lower subassembly 24. The vertical side panels 52, 54, the front panel 56 and the rear panel 58 of the upper subassembly 46 slide downwardly within the interior surfaces of the exterior walls 16, 18, 20, 22 of the lower subassembly 24. When assembled, the upper and lower subassemblies 24, 46 define a completely enclosed tub compartment 44 for receiving the rotatable fabric basket 64.

The lower panel member 24 has an upper perimeter edge 25 which matingly engages a lower perimeter edge 47 on the upper panel member 46 so as to form a split line 95, as best seen in FIGS. 1 and 2. Thus, the lower panel member 24 and upper panel member jointly form the exterior cabinet walls 16, 18, 20 and 22. The split line 95 is above the water level in the tub compartment 44.

Fabric basket 64 is comprised of a cylindrical basket wall 66 having opposite end rims 68, 70, which may be provided with a plurality of cavities 96. Basket 64 includes an inner end wall 72 and also includes a plurality of apertures 74 in the cylindrical basket wall 66. Basket 64 includes an opened front end 76 which receives the cylindrical door flange 40 of door 36 when the door is closed. When the door is opened, access to the interior of the fabric basket 64 is provided through the opened front end 76.

Figure 4:
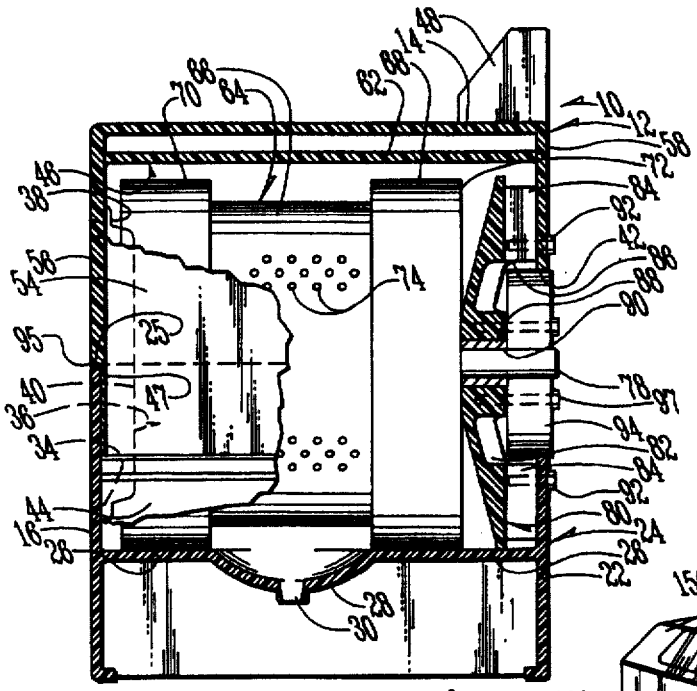
FIG. 4 is a sectional view taken along line 4—4 of FIG. 2.

A splined shaft 78 extends rearwardly from the rear wall 72 of fabric basket 64 through a bearing 88 mounted within a spinner support 80. Spinner support 80 is comprised of a circular plate 82 having rearwardly projecting vertical ribs 84 and also having a centrally located circular motor cavity 86 provided on the rear surface thereof. Spinner support 80 includes a centrally located shaft hole 90 which receives the splined shaft 78, and which is surrounded by the bearing 88. The spinner support 80 is shown in FIG. 4 to be attached to rear wall 22 of the cabinet by means of screws 92, but other securing means may be used. For example ridges or grooves may be provided in the rear wall 22 which mate with and interlock with complimentary ridges or flanges on the rear surface of spinner support 88. It is preferable that spinner support 80 be formed from molded plastic, although it may be made of other materials. A motor 94 is attached to the rearward end of splined shaft 88 and drives the fabric basket 64 rotationally.

Spin balance apparatus and methods (not shown) may be used to dynamically balance the rotating basket 64 by any of several conventionally known means such as shown in U.S. Pat. Nos. 3,800,622; 4,528,827; 4,991,247; and 5,280,6660.

Screws 97 are shown in FIG. 4 attaching the motor 94 to the spinner support 80.

Figure 5:
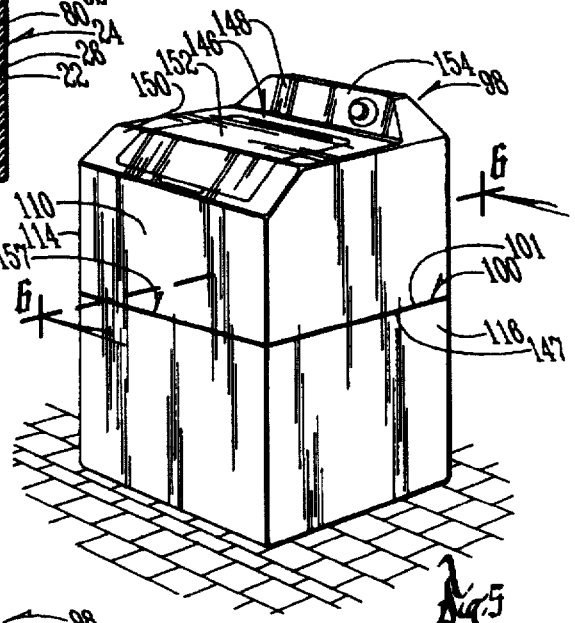
FIG. 5 is a pictorial view of a modified form of the present invention.
Figure 6:
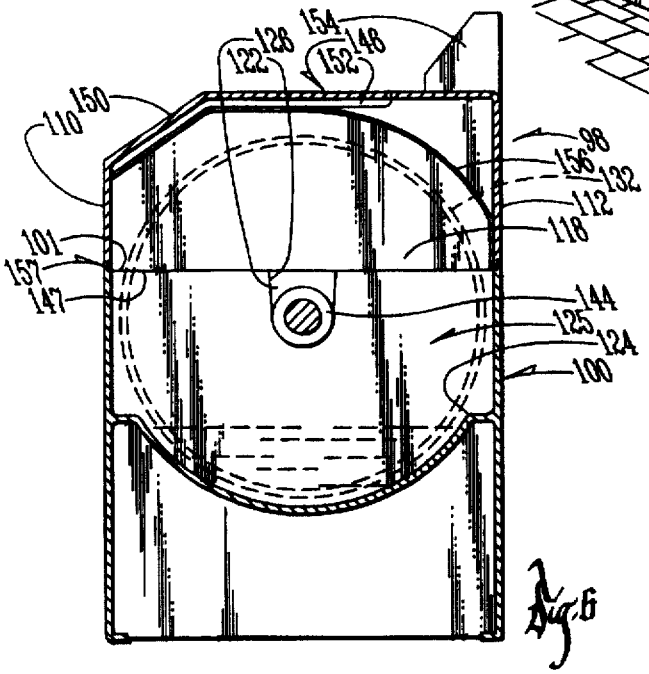
FIG. 6 is a sectional view taken along line 6—6 of FIG. 5.
Figures 7, 8, 9:
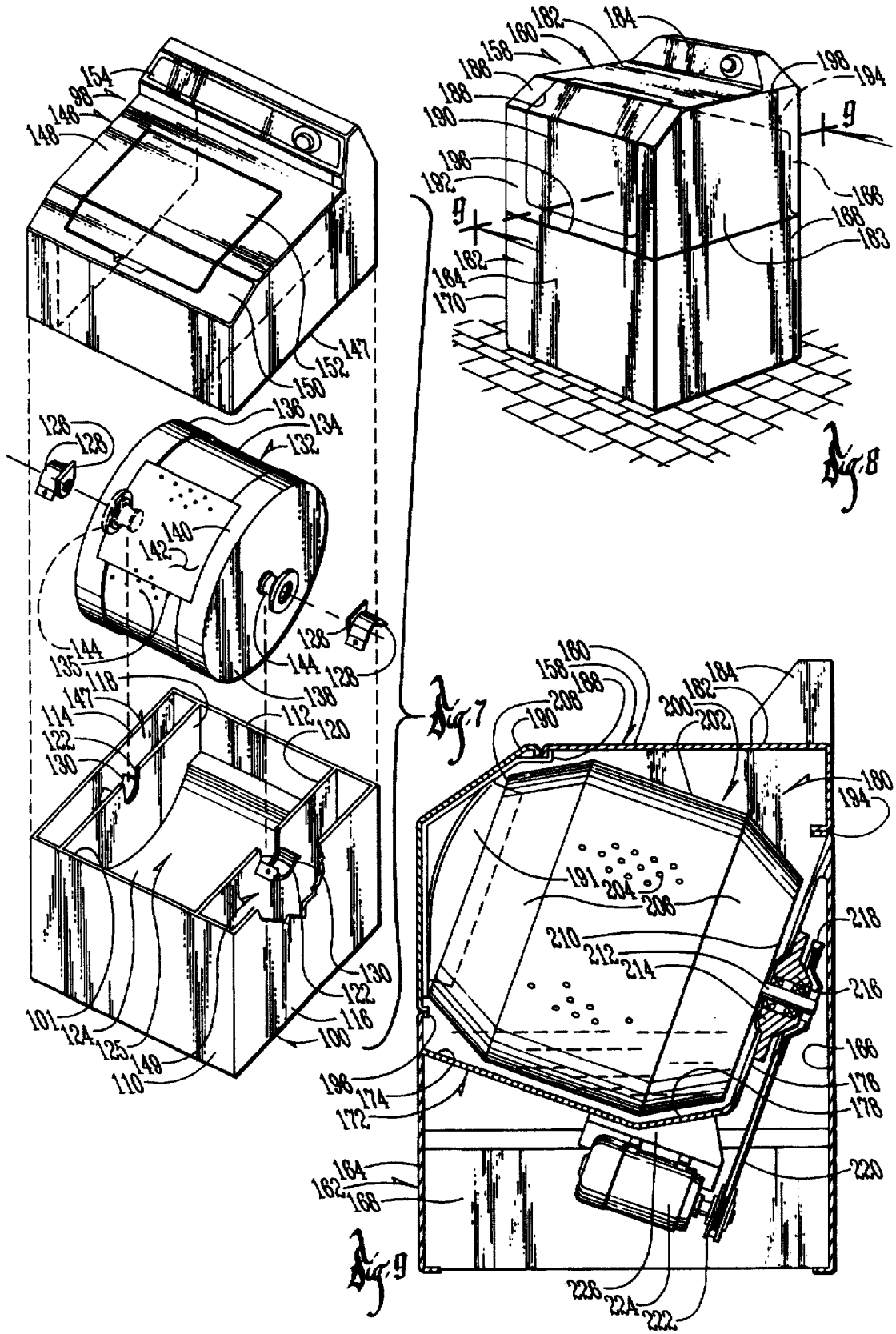
FIG. 7 is an exploded pictorial view showing the various components of the device shown in FIG. 5.
FIG. 8 is a pictorial view of a modified form of the present invention.
FIG. 9 is a sectional view taken along line 9—9 of FIG. 8.

Referring to FIGS. 5–7 a modified form of laundry appliance 98 is shown. Appliance 98 is comprised of a bottom assembly 100 and a top cover 146. Bottom subassembly 100 includes a front wall 110, a rear wall 112, a pair of opposite side walls 114, 116, and a pair of internal vertical tub walls 118, 120. Each of the vertical tub walls 118, 120 includes a vertically extending notch 122 extending downwardly from its upper edge at the center thereof. A tub wall 124 is provided at the bottom of the subassembly 100 and walls 110, 112, 118, 120, and 124 define a tub chamber 125. A pair of notch panels 126 are sized to fit in covering relation over the vertical notches 122. The notch panels 126 include a bearing housing bracket 128 at the lower end thereof formed to mate with the bearing housing brackets 130 included on the bottom assembly 100. Notch panels 126, 128 can be made of plastic or metal and can be fastened over the vertical notches 122 by a tongue and groove arrangement between the edges of the panels 126, 128 and the edges of notches 122, or by other suitable attachment means.

A laundry basket 132 includes a cylindrical wall 134 having perforations 135 therein, and end walls 136, 138. A basket access opening 140 is provided in the cylindrical wall 134 and includes a basket door 142 in covering relation thereover. A pair of bearing housings 144 protrude from the opposite axial ends of drum 132 and are adapted to be received within the bearing housing brackets 126, 130 so as to rotatably mount the basket 132 within the tub chamber 125. A motor or drive system (not shown) may be secured to the drum 132 and may be contained in either of the two end chambers 147, 149 provided on the exterior surfaces of walls 118, 120.

Top cover 146 includes a top wall 148, a canted wall 150 and a control panel 154. Top wall 148 and canted wall 150 include an access opening therein over which is provided a cabinet door 152. Cabinet door 152 may be opened and the drum 132 rotated to register the basket door 142 with the door opening at door 152. This permits access into the interior of the basket 132. Top cover 146 and door 152 also combine to form an arching top wall 156 (FIG. 6) which forms the upper boundary of the tub chamber 125. The bottom assembly 100 includes an upper perimeter edge 101 and the top cover 146 includes a lower perimeter edge 147 which matingly engage one another to define a cabinet split line 157. Thus, the bottom assembly 100 and top cover 146 jointly form the exterior cabinet walls 110, 112, 114 and 116. The split line 157 is above the level of water in the tub chamber 125.

Referring to FIGS. 8 and 9 a modified laundry appliance 158 is shown. Appliance 158 includes an upper cabinet assembly 160 and a lower cabinet assembly 162. The lower cabinet assembly 162 includes a front wall 164, a back wall 166, side walls 168, 170 and a tub panel 172. Tub panel 172 is shaped to provide in cross section inclined cylindrical portion 174 and an inclined rear portion 176 which are joined by a central portion 178. Tub panel 172 forms the bottom half of a tub cavity 180.

The upper cabinet assembly 160 includes a top wall 182, side walls 183, a control panel 184, and a canted wall 186, having a door opening 188 therein. A door 190 is fitted in covering relation over the door opening 188. At the front of upper cabinet assembly 160 is a vertical panel 192 which joins with the upper edge of the front wall 164 of lower subassembly 162 to provide a seam 196. The rear edge of upper cabinet assembly 160 joins with the upper edge of rear wall 166 of lower subassembly 160 to provide an upper seam 194. The lower edges of the side walls 183 of the upper subassembly 160 join with the upper edges of side walls 168, 170 to provide a seam 198. The seams 194, 196, 198 define a split line between the upper and lower subassemblies. The split line is above the water level in the tub cavity 180.

Rotatably mounted within tub cavity 180 is a fabric basket 200 having a cylindrical wall 202 with perforations 204 therein. At the opposite axial ends of cylindrical wall 202 are canted walls 206. The upper or front end of the basket 200 includes an opening 208 through which access can be gained when the door 190 is opened. Door 190 includes a plug 191 which is shaped to form a closure for the basket opening 208 when door 190 is closed. The lower or rear end of the basket 200 is provided with a closed end 210. A splined or keyed shaft 212 protrudes from rear end 210 through a spin support 214 having bearings 216 therein. The shaft 212 is secured to a pulley 218 around which is driven a belt 220. Belt 220 also extends around motor pulley 222 which is mounted to the drive shaft of a motor 224. Motor 224 is mounted to the bottom of the tub panel 172 by means of a motor mounting bracket 226.

Figure 10:
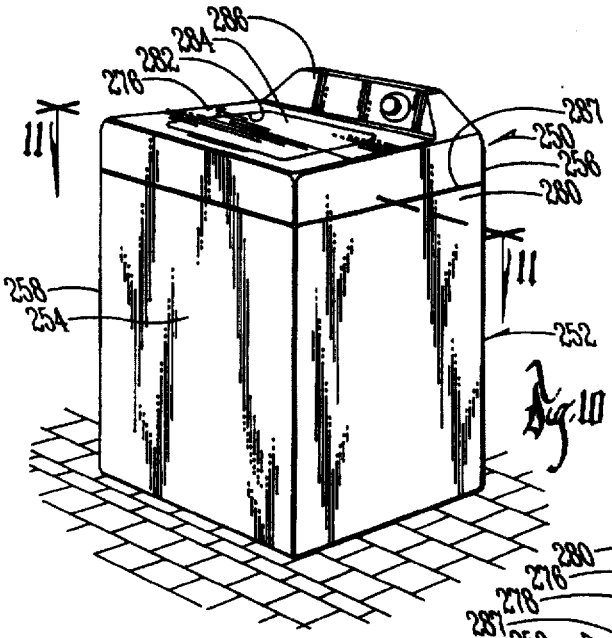
FIG. 10 is a pictorial view of a modified form of the invention.
Figure 12:
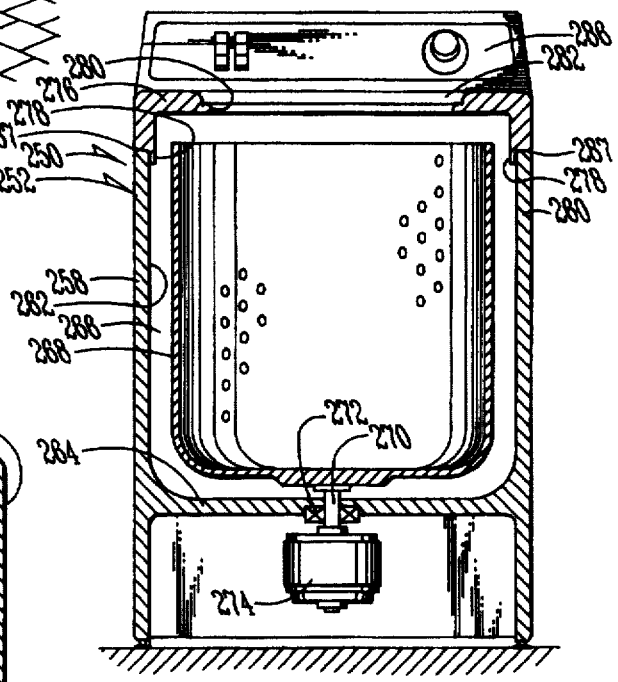
FIG. 12 is a sectional view taken along line 12—12 of FIG. 11.
Figure 11:
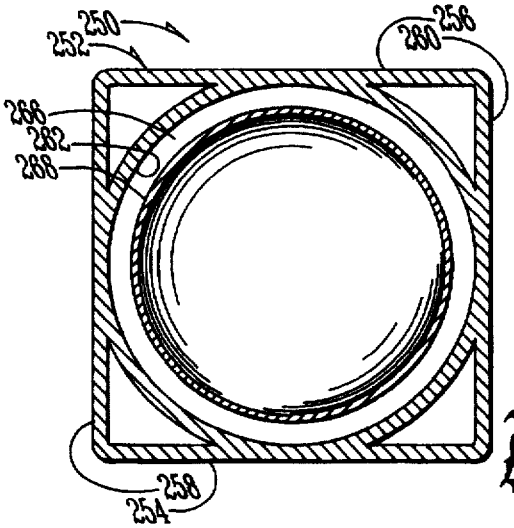
FIG. 11 is a sectional view taken along line 11—11 of FIG. 10.

Referring to FIGS. 10–12 a modified form of the invention is shown and is designated by the numeral 250. Washer 250 is a vertical axis washer and includes a unitary housing 252 comprising a front wall 254, a rear wall 256, and two side walls 258, 260. Also integrally formed as part of housing 252 are a cylindrical inner wall 262 and a horizontal dividing wall 264. Together walls 262, 264 define a chamber 266. Rotatably mounted within chamber 266 is a basket 268 having a shaft 270 extending through a bearing 272 mounted in horizontal dividing wall 264. The lower end of shaft 270 is connected to and driven by a motor 274 so as to rotate basket 268 about a vertical axis.

Fitted over the top of washer 250 is a top cover 276 having downwardly extending opposite side walls 275, a front wall 277, and a rear wall. Each wall of the top cover 276 has a downwardly extending flange 278 which protrudes within the chamber 266 and which registers the top cover 276 over the top of the unitary housing 252. Top cover 276 includes a top opening 280 and a recess 282 which is adapted to receive a lid 284. Mounted at the rear of the top cover 276 is a control panel 286. The vertical walls of the housing 252 and the top cover 276 matingly engage to define a split line 287, which is located above the maximum water level in the chamber 266.

The cabinets shown in the above described modified forms of the invention are preferably made entirely of plastic which can be molded into sub components and then joined together. However, some portions of the cabinets may be made from other materials other than molded plastic without detracting from the invention. The above invention eliminates the manufacture and assembly of a separate tub as is the case with prior laundry appliances. Because the cabinet can be manufactured from molded plastic, its weight can be considerably reduced from the weight presently exhibited in prior art laundry appliance cabinets and tubs.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A laundry appliance cabinet comprising:

a first cabinet panel member of one-piece construction;

at least one additional cabinet panel member of one-piece construction matable to said first cabinet panel member to form a plurality of exterior cabinet walls and a chamber within said exterior cabinet walls;

said chamber being fluid tight and capable of receiving a rotatable fabric basket therein;

said plurality of exterior cabinet walls comprise a top wall, a front wall, a rear wall, and side walls;

said chamber having a portion with a shape complimentary to the shape of said fabric basket; and said first cabinet panel member forming a portion of each of said front wall, said rear wall and said side walls, said at least one additional cabinet panel member forming said top wall and the remainder of said front, rear and side walls.

2. A laundry appliance according to claim 1 wherein said cabinet panel members are formed from molded plastic.

3. The laundry assembly of claim 1 wherein said at least one additional cabinet panel member has a top wall for covering the chamber.

4. A laundry appliance cabinet according to claim 1 wherein at least one of said exterior cabinet walls includes a door opening therein providing communication from outside said exterior cabinet walls into said chamber.

5. A laundry appliance according to claim 1 wherein said fabric basket includes an access opening therein, a door opening being provided in at least one of said exterior cabinet walls and being located adjacent said access opening of said basket, a door being movably mounted to said cabinet for movement from a closed position in covering relation over said door opening to an open position providing access through said door opening to said chamber.

6. A laundry appliance according to claim 1 wherein said fabric basket is mounted within said cabinet for rotation about a horizontal axis.

7. A laundry appliance according to claim 1 wherein said fabric basket is mounted within said cabinet for rotation about an inclined axis.

8. A laundry appliance according to claim 1 wherein said fabric basket is mounted for rotation about a vertical axis.

9. An appliance according to claim 1 wherein said chamber is fixedly attached to said exterior cabinet walls.

10. A laundry appliance cabinet according to claim 1 wherein said first panel member includes a first and second spaced apart vertical internal panels providing first and second opposite end walls of said chamber, first and second bearings being provided in said first and second end walls, respectively for rotatably mounting said fabric basket within said chamber.

11. The laundry appliance cabinet of claim 1 wherein said chamber has a curved wall portion spaced in close proximity to said fabric basket.

12. The laundry appliance cabinet of claim 1 wherein said chamber is fluid tight and adapted to hold a liquid.

13. The laundry appliance of claim 1 wherein the chamber has a curved wall portion and said fabric basket has a complimentary shape to the curved wall portion of said chamber.

14. A laundry appliance for washing articles in a wash fluid within a fluid tight chamber comprising:

a first cabinet panel member of one-piece construction;

a second cabinet member of one-piece construction mateable to the first cabinet panel member to form a plurality of vertical exterior cabinet walls and a chamber within said exterior cabinet walls;

said chamber being fluid tight and capable of receiving a rotatable fabric basket therein and wherein in normal operation the chamber fills with fluid to a predetermined level to wash articles;

said first and second panel members defining a split line along the point of connection; and said split line being above a normal operating fluid level of the chamber.

15. A laundry appliance according to claim 14 wherein said cabinet panel members are formed from molded plastic.

16. The laundry appliance of claim 14 wherein the second panel member has a top wall for covering the chamber.

17. A laundry appliance cabinet according to claim 14 wherein at least one of said exterior cabinet walls includes a door opening therein providing communication from outside said exterior cabinet walls into said chamber.

18. A laundry appliance according to claim 14 wherein said fabric basket includes an access opening therein, a door opening being provided in at least one of said exterior cabinet walls and being located adjacent said access opening of said basket, a door being movably mounted to said cabinet for movement from a closed position in covering relation over said door opening to an open position providing access through said door opening to said chamber.

19. The laundry appliance cabinet of claim 14 wherein said chamber is fluid tight and adapted to hold a liquid.

20. The laundry appliance of claim 14 wherein the chamber has a curved wall portion and said fabric basket has a complimentary shape to the curved wall portion of said chamber.

* * * * *